US007241508B2

(12) United States Patent
Corrigan et al.

(10) Patent No.: US 7,241,508 B2
(45) Date of Patent: Jul. 10, 2007

(54) FRAGRANCE RELEASE PAPER

(75) Inventors: Christopher James Corrigan, Lake Oswego, OR (US); David Randolph Goss, Vancouver, WA (US)

(73) Assignee: West Linn Paper Company, West Linn, OR (US)

( * ) Notice: Subject to any disclaimer, the term of this patent is extended or adjusted under 35 U.S.C. 154(b) by 0 days.

(21) Appl. No.: 11/247,093

(22) Filed: Oct. 12, 2005

(65) Prior Publication Data

US 2007/0082212 A1 Apr. 12, 2007

(51) Int. Cl.
*B32B 5/66* (2006.01)

(52) U.S. Cl. ..... 428/532; 428/533; 428/534; 428/535; 428/536; 428/537.5; 162/158; 162/164.1; 162/174; 162/175; 162/181.1

(58) Field of Classification Search ..... 428/532, 428/533, 534, 535, 536, 537.5; 162/158, 162/164.1, 174, 175, 181.1
See application file for complete search history.

(56) References Cited

U.S. PATENT DOCUMENTS 4,737,239 A * 4/1988 Bernheim et al. ..... 162/158

* cited by examiner

*Primary Examiner*—Leszek Kiliman
(74) *Attorney, Agent, or Firm*—Evelyn M. Sommer

(57) ABSTRACT

An improved pigment-coated paper is provided which enables the use of a non-acidic basesheet in the manufacture of a fragrance release paper. The non-acidic basesheet, compared to the conventionally used acidic basesheet, is brighter and less brittle, and therefore imparts improved visual effects and reduces the likelihood of cracking. The clay-based coating composition is mildly alkaline when wet (pH between 7.5 and 8.5) and upon drying on the basesheet, becomes mildly acidic (pH between 6.0 and 7.0). A method of making the improved pigment-coated paper using a non-acidic basesheet in the manufacture of a fragrance release paper is provided, comprising the steps of preparing the basesheet, applying the premixed pigment coating composition using rollers and blade leveling devices, and drying the pigment coating composition. A fragrance sample construction, for use in magazines, catalogs, leaflets, etc., is provided comprising a burstable fragrance in a releasable adhesive between two opposing segments of the improved sheet of pigment coated paper where one of the segments overlaps a portion of the other segment so that the separation of the two segments releases the sample fragrance.

18 Claims, No Drawings

FRAGRANCE RELEASE PAPER

FIELD OF THE INVENTION

The invention relates to a fragrance release paper and to an improved pigment-coated paper for use in the manufacture of fragrance release paper. More particularly, the invention relates to the use of a pigment-coated non-acidic basesheet for use in the manufacture of a fragrance release paper, wherein the basesheet possesses an improved brightness and reduced brittleness without adversely affecting the properties of the fragrances as well as the fragrance release paper formed by the invention. The invention further relates to a method for making such improved pigment-coated paper.

BACKGROUND OF THE INVENTION

The prior art has provided numerous sampler devices for use in connection with promotion of the sale of fragrances and other products. Known samplers typically are inserted into magazines and catalogs, are used as statement enclosures, or are handed out individually by salespersons at retail establishments. Such samplers typically are of a non-laminar construction and comprise one sheet of a substrate, such as paper, which sheet is temporarily bonded to itself with an adhesive. Microencapsulated fragrance oil is disposed within the adhesive, such that the adhesive both bonds the microcapsules to the substrate sheet and binds together the interior faces of the substrate sheet. When a user separates the sheets, some or all of the microcapsules rupture, thereby releasing the fragrance contained therein for evaluation by the user. A layer of a barrier material, such as a plastic or metal foil, may be utilized to overwrap the sampler to prevent leakage of the fragrance from the sampler. For instance, U.S. Pat. Nos. 5,188,236, 5,391,420, 4,925,517, and 4,817,860 all disclose releasing fragrance samples through bursting microcapsules adhered to a substrate paper or cardboard backing.

For the manufacturing of fragrance release paper, coated paper is typically preferred and is a conventional and standard item in commerce. It is generally a fibrous sheet having a pigment-bearing resinous coating on one or both sides. Usually the pigment provides a white, bone or ivory coloration to the sheet and typical pigments for producing the commonly used white coated paper are fine white pigment such as clay, calcium carbonate, titania, silica, zinc oxide, etc. A colorless and/or transparent binder, comprising generally synthetic or natural organic polymeric material, is used. The fragrance, incorporated in microcapsules in a suitable formulation, i.e., in a binder or adhesive, is then applied on top of the pigment-bearing coating.

One critical property to prevent the discoloration of the fragrance is that the surface pH of the coating is 7.0 or less. The fragrance formulations are very sensitive to calcium carbonate and pH. Historically the discoloration has been successfully prevented using an acid based base-sheet (pH 4-6.5) without any calcium carbonate in the base sheet, which is then coated with a kaolin clay based formulation.

However, as disclosed in U.S. Pat. No. 4,737,239, it is known that considerable disadvantages must be accepted when manufacturing paper under acid conditions, for example the insufficient storage stability and mechanical strength of the acid-sized paper, the acid waste-waters resulting from the process, and the use of relatively expensive fillers such as kaolin or montmorillonite which have to be added on account of the acid pH value of the fiber-suspensions. The acid pH value of the fiber suspension may also cause corrosion in sensitive paper machines and, in addition, rules out the addition of inexpensive fillers such as calcium carbonate, especially chalk. As chalk imparts a high degree of whiteness to the sized paper, a disproportionately large amount of fluorescent whitening agent has to be added in the process for the manufacture of acid-sized paper so as to obtain a sufficiently high degree of whiteness. The acid based paper also has high brittleness which could result in cracking. Finally, it must be mentioned that, according to German "Offenlegungsschrift" U.S. Pat. No. 2,459,165, relatively large amounts of sizing agents are required for processing fiber suspensions to paper.

Accordingly, it is an object of the present invention to provide an improved pigment-coated paper which enables the use of a non-acidic basesheet in the manufacture of a fragrance release paper.

It is another object of the present invention to provide an improved pigment-coated paper which is brighter and less brittle for use in the manufacture of a fragrance release paper.

It is a further object of the present invention to provide a method for preparing an improved pigment-coated paper which enables the use of a non-acidic basesheet in the manufacture of a fragrance release paper.

It is yet another object of the present invention to provide a method for preparing an improved pigment-coated paper which is brighter and less brittle for use in the manufacture of a fragrance release paper.

It is still another object of the invention to provide a fragrance release paper construction for delivering a sample of fragrance suitable to use as an insert in a magazine or incorporation into a leaflet.

SUMMARY OF THE INVENTION

An improved pigment-coated paper is provided which enables the use of a non-acidic basesheet in the manufacture of a fragrance release paper. The non-acidic basesheet, compared to the conventionally used acidic basesheet, is brighter and less brittle, and imparts improved visual effects and reduces the likelihood of cracking. The preferred non-acidic basesheet is a prepared from a blend of softwood and hardwood bleached chemical pulp, usually at the ratio of 30:70, with a portion of repulped broke being added at 15-20% of the total furnish. The basesheet is produced under mild alkaline conditions with a pH between 7.2 and 8.0, preferably 7.6. The pigment coating composition comprises clay (preferably structured clay and glossing clay in a 30:70 ratio), latex binder, and additives. The clay blend which is preferably used is a structured and glossing clay. The pH of the pigment coating composition changes from its value between 7.5 to 8.5 when the composition is wet to 6.0-7.0 when the composition is dry. In accordance with the invention, a method of making the improved pigment-coated paper using a non-acidic basesheet adapted for the manufacture of a fragrance release paper is provided, comprising the steps of preparing the basesheet, applying the premixed pigment coating composition using rollers and blade leveling devices, and drying the pigment coating composition. Further in accordance with the invention, a fragrance sampler surface is provided by incorporating fragrance in microcapsules and applying the fragrance-loaded microcapsules onto the improved pigment-coated paper with the non-acidic basesheet. The fragrance sampler, for use in magazines, leaflets, etc., can be constructed by folding two opposing segments of the improved pigment-coated paper where at least one segment has microcapsules deposited thereon. Separation of the two segments ruptures the fragrance-loaded microcapsules and releases the sample fragrance.

DETAILED DESCRIPTION OF THE INVENTION

The fragrance release paper of the present invention is made by coating a base-sheet, which is produced under mild alkaline conditions (pH 7.2 to 8.0), preferably 7.6, with a kaolin clay based coating composition comprising:

1. 100 parts by weight of clay, preferably a structured and glossing clay,
2. 10 parts by weight of latex binder (12 parts per hundred parts of pigment), and
3. 1-3 parts by weight of additives (preferably 1.25 parts per hundred parts of pigment).

Kaolin is a commercial clay composed principally of the hydrated aluminosilicate clay mineral kaolinite. Kaolin has been widely used in the paper industry both as a filler and a coating pigment. As a filler, it is incorporated into the paper web, both reducing its cost and improving its printing characteristics. As a coating pigment, it is used to enhance the surface properties of the paper, such as brightness, smoothness, gloss and ink receptivity. The pigment component is essentially 100% clay and may consist of about 30 parts by weight structured clay and 70 parts by weight glossing clay. In a preferred embodiment, the pigment component comprises a 30/70 mixture of structured clay and glossing clay. A preferred example of the structured clay useful in the invention is sold under the trademark Covergloss® by J. M. Huber Corporation. A preferred example of the glossing clay useful in this invention is sold by J. M. Huber Corporation and preferably is a product known as Huber Gloss. The particle sizes of the structured clay and the glossing clay are not critical as is the selection of high glossing and high brightness producing clays.

The binder component of the coating composition in accordance with the present invention is preferably used in latex form, i.e., microscopic particles of synthetic thermoplastic polymer suspended in a water vehicle by the aid of emulsifying and/or stabilizing agents. Particularly preferred are the resins which exhibit primarily elastomeric properties, often described as the rubbery polymers, such as a styrene-butadiene, styrene-isoprene, acrylate, styrene-butadiene acrylonitrile, acrylic latex, vinyl acetate latex, or styrene acrylic copolymers. Suitable commercial examples are the latexes sold by Dow Chemical Company comprising styrene butadiene acrylonitrile copolymers.

Other binders such as starch, casein, gelatin, alginates and soybean proteins, hydroxyethylcellulose, methylcellulose, carboxymethylcellulose and cationically modified starch can be used solely or as a cobinder. However, a synthetic thermoplastic latex binder is preferably employed as the sole binding agent since the use of natural, non-thermoplastic adhesives such as casein, soy protein and starch in an amount sufficient to contribute significant binding action results in a decrease in gloss. The addition to the binder of a minor proportion, i.e. up to 3 parts per hundred parts of pigment, of a non-thermoplastic adhesive in the coating composition, however, can be advantageous in that it may improve coater performance.

A wide spectrum of additives may also be added to the coating composition, in amounts of up to about 68% by weight, to provide additional control over application properties such as solids, viscosity, rheology, waterholding, and pH, and to help to achieve the final paper properties required, such as surface strength, smoothness, gloss, brightness, opacity and shade.

A rheology modifier is generally used to adjust or modify the rheological properties of the coating compositions. Such properties include viscosity, flow rate, stability to viscosity change over time, and the ability to suspend particles in the aqueous composition. Suitable rheology modifiers include, for example, polyacrylates, emulsion copolymers, dicyanamide, triols, polyoxyethylene ether, urea, sulphated castor oil, polyvinyl pyrrolidone, montmorillonite, polyvinyl alcohols, CMC (carboxymethyl celluloses), sodium alginate, xanthan gum, sodium silicate, acrylic acid copolymers, HMC (hydroxymethyl celluloses), HEC (hydroxyethyl celluloses), starches, proteins and others. Among these, CMC is the most preferred rheology modifier according to the present invention. The rheology modifier is present in the coating composition in levels from about 0.25% to about 1%, preferably about 0.7%, by weight of the coating composition.

The coating composition may further contain dispersants in levels from about 0.1% to about 1.5%, preferably about 1% by weight of the coating composition. Dispersants assist with multiple functions that occur simultaneously to improve the coating performance: wetting, dispersion and stabilization against particle agglomeration. Suitable dispersants are polyelectrolytes, such as polyanions exemplified by polyphosphoric acids or polyacrylic acids (polysalts), polyacrylates and copolymers containing polyacrylate species, especially polyacrylate salts (e.g., sodium and aluminium optionally with a group II metal salt), sodium hexametaphosphates, non-ionic polyol, polyphosphoric acid, condensed sodium phosphate, non-ionic surfactants, alkanolamine and other reagents commonly used for this function.

The coating composition may contain defoamers/antifoamers in amounts as required to prevent and/or control foaming. Examples of suitable defoamers are blends of surfactants, tributyl phosphate, fatty polyoxyethylene esters plus fatty alcohols, fatty acid soaps, silicone emulsions and other silicone containing compositions, waxes and inorganic particulates in mineral oil, blends of emulsified hydrocarbons and other compounds sold commercially.

One or more fluorescent dyes, such as distilbene, benzoxazole, coumarin, imidazole, benzimidazole and pyrazoline dyes, are preferably added in levels from about 0.02% to about 1.0% to impart high brightness and gloss. Preferred dyes include Bayer Blancophor, Ciba Tinapol and Clarion Leucophor.

Biocides are also preferably added to the coating composition to prevent spoilage by microbes. Examples of the biocides include metaborate, sodium dodecylbenene sulphonate, thiocyanate, organosulphur, sodium benzonate and other compounds sold commercially for this function, for example, Hercules DBNPA, dibromo-monopropioamide.

Caustic, such as NaOH, is added to adjust the pH of the coating composition to the desired range (7.5 to 8.5 when wet, preferably 8.0).

The following example is provided as a preferred pigment coating formulation according to the present invention. It possesses a final viscosity of about 6000 to about 7000 cps @ 20 RPM.

| Ingredients | Percent (parts by weight) |
|---|---|
| Covergloss ® clay | 30 parts |
| Huber Gloss clay | 70 parts |
| CMC (rheology modifier) | 0.7 parts |
| Styrene Butadiene Acrylonitrile (binder) | 12 parts |
| Dispersant | 0.4 parts |
| Defoamer | As needed |
| Fluorescent dye | 0.15 parts |
| Biocide | As needed |
| Caustic | As needed for target pH (7.5-8.5) |
| Water | As needed for target solids |

The preferred basesheet is a blend of softwood and hardwood bleached chemical pulps, usually at the ratio of 30:70, with a portion of repulped broke (waste, internal spoilage, trim loss) being added at 15-20% of the total furnish. These pulps are refined in specific ways to increase fiber to fiber bonding, and increase fiber flexibility without decreasing fiber length. The basesheet ash content is typically about 10% total ash content, with 0-4% supplied by addition of calcium carbonate to the furnish. The basesheet is produced under mild alkaline conditions with the final pH of between 7.2 and 8.0, preferably 7.6. The ream weight of the basesheet is about 50 to about 70 pounds, and preferably about 51 pounds, per 3300 square feet.

The methods of producing the coating composition is basically conventional but in this case the caustic, such as sodium hydroxide, potassium hydroxide, calcium hydroxide, and magnesium hydroxide, is added to the coating composition during preparation so that the pH of the composition is 7.5 to 8.5, preferably 8.0. On drying, the resulting dry coating has a pH of 6-7. It is believed that during the drying at least a part of the water present in the coating composition migrates into the underlying paper sheet producing a shift in the pH of the coating composition into the acidic range.

The coating, when applied to the basesheet, acts as a barrier between the fragrance oil solution and the alkaline basesheet. The coating barrier properties are optimal when the coatweight is in the amount of about 17.6 pounds to about 24 pounds per 3300 square feet of final product, resulting in a total ream weight of about 70 pounds.

Methods of coating paper and other sheet materials are widely published and well known. For example, there is a review of such methods published in Pulp and Paper International, May 1994, page 18 et seq. Sheets may be coated on the sheet forming machine, i.e., "on-machine", or "off-machine" on a coater or coating machine. The preferred means according to the present invention is a continuous on-machine process. Use of high solids compositions is desirable in the coating method because it leaves less water to evaporate subsequently. However, as is well known in the art, the solids level should not be so high that high viscosity and leveling problems are introduced.

All known methods of coating according to the present invention require (i) a means of applying the coating composition to the material to be coated, namely an applicator; and (ii) a means for ensuring that a correct level of coating composition is applied, namely a metering device. When an excess of coating composition is applied to the applicator, the metering device should be placed downstream of it. Alternatively, the correct amount of coating composition may be applied to the applicator by the metering device, e.g., as a film press. The coating composition is generally applied to produce three different basis weights, 60 lb, 70 lb and 80 lb, with the finished weight of 70 lb being the preferred basis weight. At the points of coating application and metering, the paper web support ranges from a backing roll, e.g. via one or two applicators, to nothing (i.e., just tension). The time the coating is in contact with the paper before the excess is finally removed is the dwell time and this may be short, long or variable.

The coating is usually added by a coating head at a coating station. According to the quality desired, paper grades are uncoated, single coated, double coated and even triple coated. When providing more than one coat, the initial coat (precoat) may have a cheaper formulation and optionally less pigment in the coating composition. A coater that is applying a double coating, ie. a coating on each side of the paper, will have two or four coating heads, depending on the number of sides coated by each head. Most coating heads coat only one side at a time, but some roll coaters (eg film press, gate roll, size press) coat both sides in one pass. In one preferred embodiment, the coating composition of the present invention is applied to a single side of the basesheet in a single application step. In another preferred embodiment, the coating composition is applied first to produce a precoat with low coatweight, coverage and low pigment content, then the composition is applied to the precoat so that the topcoat can be held up by the precoat, duplicating the type of coatweight, coverage and pigment content achievable with a single application step.

Examples of known coaters which may be employed include air knife coaters, blade coaters, rod coaters, bar coaters, multi-head coaters, roll coaters, roll/blade coaters, cast coaters, laboratory coaters, gravure coaters, kiss coaters, liquid application systems, reverse roll coaters and extrusion coaters. In one preferred embodiment of the present invention, the coater comprises a roll applicator and a blade leveling device.

Microencapsulation is a well known micro-packaging technique which involves deposition of thin polymeric coatings to minute particles of solids, droplets of liquids, or dispersions of solids in liquids. Microcapsules are widely used in the fragrance sampling devices. They are capable of holding fragrances while intact and releasing fragrances while ruptured under pressure. Compositions and methods of making microcapsules with encapsulated fragrances and/or other actives are well known in the art, for example, in U.S. Pat. No. 3,519,941, titled "Microcapsules and Process of Making." Common compositions and methods of applications of the encapsulated fragrance coating composition can be found in the prior art, such as in U.S. Pat. Nos. 4,925,517, 4,988,557, 4,899,755, and Re. 32,713.

The fragrance may be any of many essential oils, essences, or scented concentrates available as trade-marked products from companies in the fragrance and food business. The term fragrance is thus used herein to include any of various liquids with volatile scents and is preferably a perfume.

In accordance with a preferred embodiment of the invention, the fragrance, perfume or scent is applied on to the coated paper as herein described so that it is enclosed in a printed paper flap that can be opened to release the fragrance. The paper is folded along a fold line so that a first segment overlaps a second segment in face to face relation along the folded line. The fragrance applied is incorporated into microcapsules distributed in a releasable adhesive or binder. The fragrance is released when the flap is unfolded. Unfolding of the flap, i.e., separation of the segments causes the capsules to burst releasing the fragrance. The aforesaid construction for delivering a sample of a fragrance can be used as an insert in a magazine, leaflet, catalog, billing statement, etc.

While the invention has been particularly shown and described with reference to preferred embodiments thereof, it is understood that various other changes and modifications thereof will occur to a person skilled in the art without departing from the spirit and scope of the invention as defined in the specification and the appended claims.

What is claimed is:

1. An improved pigment-coated paper for use in manufacturing a fragrance release paper comprising:

a) a non-acidic basesheet comprising a blend of softwood and hardwood bleached chemical pulps at the ratio of 30:70 by weight, wherein said basesheet is mildly alkaline, b) a coating composition comprising 100 parts by weight of clay, 10 parts by weight of binder and about 1 to about 3 parts by weight of additives applied onto said basesheet, and c) water, said water being introduced as part of the components of said coating composition or separately as needed, wherein said coating is mildly alkaline when said coating is wet and becomes mildly acidic after said coating is dried on the basesheet.

2. An improved pigment-coated paper according to claim 1, wherein said non-acidic basesheet possesses a pH of between about 7.2 and about 8.0.

3. An improved pigment-coated paper according to claim 1, wherein said coating possesses a pH of between about 7.5 and about 8.5 when said coating is wet.

4. An improved pigment-coated paper according to claim 1, wherein said coating possesses a pH of between about 6.0 and about 7.0 after said coating is dried.

5. An improved pigment-coated paper according to claim 1, wherein said non-acidic basesheet further comprises a portion of repulped broke in amounts of about 15 to about 20% of the total furnish.

6. An improved pigment-coated paper according to claim 1 wherein said clay comprises kaolin clay and spare pigment at a ratio of 30:70, by weight.

7. An improved pigment-coated paper according to claim 1 wherein said binder is at least one member selected from the group consisting of styrene-butadiene acrylonitrile, styrene-butadiene, acrylate, styrene-isoprene, acrylic latex, vinyl acetate latex, and styrene acrylic copolymers.

8. An improved pigment-coated paper according to claim 7 wherein said binder further comprises at least one member selected from the group consisting of starch, casein, gelatin, alginates, soybean proteins, hydroxyethylcellulose, methylcellulose, carboxymethylcellulose and cationically modified starch.

9. An improved pigment-coated paper according to claim 1 wherein said additive is at least one member selected from the group consisting of dispersants, defoamers, fluorescent dyes, biocides, caustic and rheology modifiers.

10. An improved pigment-coated paper according to claim 9 wherein said dispersant is at least one member selected from the group consisting of polyelectrolytes, polyacrylates, polyacrylate salts, sodium hexametaphosphates, non-ionic polyol, polyphosphoric acid, condensed sodium phosphate, non-ionic surfactants, and alkanolamine.

11. An improved pigment-coated paper according to claim 9 wherein said defoamer is at least one member selected from the group consisting of blends of surfactants, tributyl phosphate, fatty polyoxyethylene esters plus fatty alcohols, fatty acid soaps, silicone emulsions, waxes and inorganic particulates in mineral oil and blends of emulsified hydrocarbons.

12. An improved pigment-coated paper according to claim 9 wherein said fluorescent dye is at least one member selected from the group consisting of distilbene, benzoxazole, coumarin, imidazole, benzimidazole and pyrazoline dyes.

13. An improved pigment-coated paper according to claim 9 wherein said biocide is at least one member selected from the group consisting of metaborate, sodium dodecylbenene sulphonate, thiocyanate, organosuiphur, and sodium benzonate.

14. An improved pigment-coated paper according to claim 9 wherein said rheology modifier is at least one member selected from the group consisting of polyacrylates, emulsion copolymers, dicyanamide, triols, polyoxyethylene ether, urea, sulphated castor oil, polyvinyl pyrrolidone, montmorillonite, polyvinyl alcohols, carboxymethyl celluloses, sodium alginate, xanthan gum, sodium silicate, acrylic acid copolymers, hydroxymethyl celluloses, hydroxyethyl celluloses, starches, and proteins.

15. An improved pigment-coated paper according to claim 9 wherein said caustic is at least one member selected from the group consisting of sodium hydroxide, potassium hydroxide, magnesium hydroxide, and calcium hydroxide.

16. A method for manufacturing an improved pigment-coated paper for use in the manufacturing of a fragrance release paper comprising the steps of a) preparing a basesheet under non-acidic conditions, b) applying a coating formulation having a pH of between about 7.5 and about 8.5 to said basesheet, and c) drying the coating formulation to produce a coating having a pH of between about 6.0 and about 7.0, wherein said basesheet comprises a blend of softwood and hardwood bleached chemical pulps at the ratio of 30:70 by weight with a pH of between about 7.2 and about 8.0, and wherein said coating formulation comprises 100 parts by weight of clay, 10 parts by weight of binder and about 1 to about 3 parts by weight of additives.

17. A fragrance sampler comprising a) a sheet of said improved pigment-coated paper according to claim 1, having a first segment and a second segment opposing each other, b) a releasable adhesive located on at least a first portion of said first segment and at least a first portion of said second segment, and c) a burstable fragrance located on said releasable adhesive, wherein a second portion of said first segment overlaps with a second portion of said second segment and said burstable fragrance is released upon separation of said second portion of said first segment from said second portion of said second segment.

18. A fragrance sampler according to claim 17 wherein a portion of one of said first and second segments is free of overlapping segment and is bound into a magazine, catalog or leaflet.

* * * * *